US009845136B2

(12) United States Patent
Watkins

(10) Patent No.: US 9,845,136 B2
(45) Date of Patent: Dec. 19, 2017

(54) DECK WASH SYSTEM FOR BOAT

(71) Applicant: Yamaha Motor Corporation, USA, Cypress, CA (US)

(72) Inventor: Scott Watkins, Canton, GA (US)

(73) Assignee: YAMAHA MOTOR CORPORATION, USA, Cypress, CA (US)

( * ) Notice: Subject to any disclaimer, the term of this patent is extended or adjusted under 35 U.S.C. 154(b) by 0 days.

(21) Appl. No.: 14/608,379

(22) Filed: Jan. 29, 2015

(65) Prior Publication Data

US 2016/0221653 A1 Aug. 4, 2016

(51) Int. Cl.
*B63B 59/00* (2006.01)
*B63H 11/02* (2006.01)

(52) U.S. Cl.
CPC ..... *B63B 59/00* (2013.01); *B63H 11/02* (2013.01)

(58) Field of Classification Search
CPC ..... B63B 59/00; B63H 11/02
See application file for complete search history.

(56) References Cited

U.S. PATENT DOCUMENTS 3,078,661 A * 2/1963 Spence ..... B63H 11/117 114/151
3,384,047 A * 5/1968 Remley ..... A63H 23/10 440/39
3,613,630 A * 10/1971 Jacuzzi ..... B63H 11/11 114/184
5,299,960 A * 4/1994 Day ..... B63H 11/107 440/39
5,516,313 A * 5/1996 Lumpkin ..... B63H 11/11 440/38
6,146,219 A * 11/2000 Blanchard ..... B63H 11/11 440/38
6,857,583 B2 2/2005 Attar
7,077,338 B1 * 7/2006 Williamson ..... B63J 2/12 114/343
8,490,558 B2 7/2013 Foley et al.
2012/0024211 A1 * 2/2012 Wiltse ..... B63B 1/14 114/39.21

* cited by examiner

*Primary Examiner* — Anthony D Wiest
(74) *Attorney, Agent, or Firm* — Keating and Bennett, LLP

(57) ABSTRACT

A boat includes a hull, a deck, an engine disposed between the hull and the deck, and a jet propulsion unit including a jet nozzle configured to jet water therefrom. The jet nozzle includes a hole to which a water passage is connected and is configured to supply pressurized water from the jet nozzle to a water intake opening located in an interior of the hull. The water intake opening is connected to an interior water passage disposed in the interior of the hull and between the hull and the deck. The interior water passage is connected to a deck hose used to wash the boat.

11 Claims, 10 Drawing Sheets

| REMOCON POSITION | F | N | R |
|---|---|---|---|
| WASH DOWN MODE | NOT AVAILABLE | AVAILABLE | NOT AVAILABLE |
| ENGINE RPM | 3000RPM WHILE IN WASH DOWN MODE<br>7800 ← 1300 → 4500 | | |
| WATER PRESSURE (PSI) NORMAL SPECS | 5PSI WHILE IN WASH DOWN MODE<br>90 ← 0 → 20 | | |

FIG. 9

DECK WASH SYSTEM FOR BOAT

BACKGROUND OF THE INVENTION

1. Field of the Invention

The present invention relates to a deck wash system for a boat. More specifically, the present invention relates to a deck wash system for a jet boat.

2. Description of the Related Art

Conventionally, a deck wash system for a boat includes a water reservoir including a pump inside the water reservoir to pump water from the reservoir to a hose used to wash the deck of the boat. However, the water reservoir occupies some of the limited space on the boat, increases the weight of the boat, and the pump and the electric motor used to drive the pump increase the cost of the boat.

SUMMARY OF THE INVENTION

The inventor of preferred embodiments of the present invention described and claimed in the present application has discovered a novel and unique deck wash system that utilizes the water pressure created in a jet propulsion unit provided on the boat to provide water to wash the deck. Additionally or alternatively, the water pressure created in the jet propulsion unit is preferably utilized to provide water to other devices on the boat, such as a baitwell (also known as a livewell), one or more ballast tanks, etc.

According to a preferred embodiment of the present invention, a boat includes a body including a hull and a deck; an engine disposed between the hull and the deck; a jet propulsion unit configured to be driven by the engine, the jet propulsion unit including a jet nozzle configured to jet water therefrom; a water passage configured to supply water from the jet nozzle to a water intake opening located in an interior of the hull; and an interior water passage disposed in the interior of the hull and between the hull and the deck; wherein the interior water passage includes a first end connected to the water intake opening and a second end configured to discharge water to the interior of the hull.

Preferably, the water intake opening includes a shut-off valve located in the interior of the hull, wherein the shut-off valve is configured to stop water from being supplied to the interior of the hull. Accordingly, when the shut-off valve is closed, the shut-off valve prevents water from being supplied to the interior of the hull.

According to a preferred embodiment of the present invention, the second end of the interior water passage is connected to a deck discharge opening on the deck, wherein the deck discharge opening includes a fitting valve. The fitting valve is configured to be moved to at least a first position to supply water from the interior water passage to the deck discharge opening and a second position to prevent water from being supplied from the interior water passage to the deck discharge opening.

Preferably, the boat includes a deck hose configured to be connected to the deck discharge opening so that a passenger on the boat may wash the deck or the hull of the boat with water sprayed from the deck hose.

According to a preferred embodiment of the present invention, the interior water passage preferably includes a multi-way valve. The multi-way valve is configured to switch the supply of pressurized water from the jet nozzle to various devices on the boat. For example, the multi-way valve is preferably configured to switch the supply of water to the deck hose, to a baitwell, or to one or more ballast tanks on the boat.

Preferably, a portion of the interior water passage extends from the multi-way valve to the deck, in particular, to the deck discharge opening to which the deck hose is connected.

According to a preferred embodiment of the present invention, the boat includes a cockpit and an engine control unit, wherein the cockpit preferably includes a deck wash switch. When the deck wash switch is on, the engine control unit is configured or programmed to operate the engine at a predetermined rpm. Accordingly, the jet propulsion unit, which is driven by the engine, provides water from the jet nozzle to the interior of the hull at a desired water pressure.

The jet nozzle preferably includes a water inlet configured to receive water from an impeller of the jet propulsion unit, a water outlet configured to jet the water rearward, and a hole located between the water inlet and the water outlet. The hole is connected to the water passage. Thus, the pressurized water between the water inlet and the water outlet of the jet nozzle is supplied by the water passage to the interior of the hull.

Preferably, the jet nozzle is disposed outside of the hull.

According to another preferred embodiment of the present invention, the second end of the interior water passage is connected to a baitwell. Accordingly, a portion of the interior water passage extends from the multi-way valve to the baitwell.

According to another preferred embodiment of the present invention, the second end of the interior water passage is connected to one or more ballast tanks on the boat. Accordingly, one or more portions of the interior water passage extend from the multi-way valve to the one or more ballast tanks.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 9 is a chart showing an example of a relationship between engine rpm and water pressure during a wash down mode.

DETAILED DESCRIPTION OF THE PREFERRED EMBODIMENTS

Hereinafter, preferred embodiments of the present invention will be described with reference to the drawings.

Figure 1:
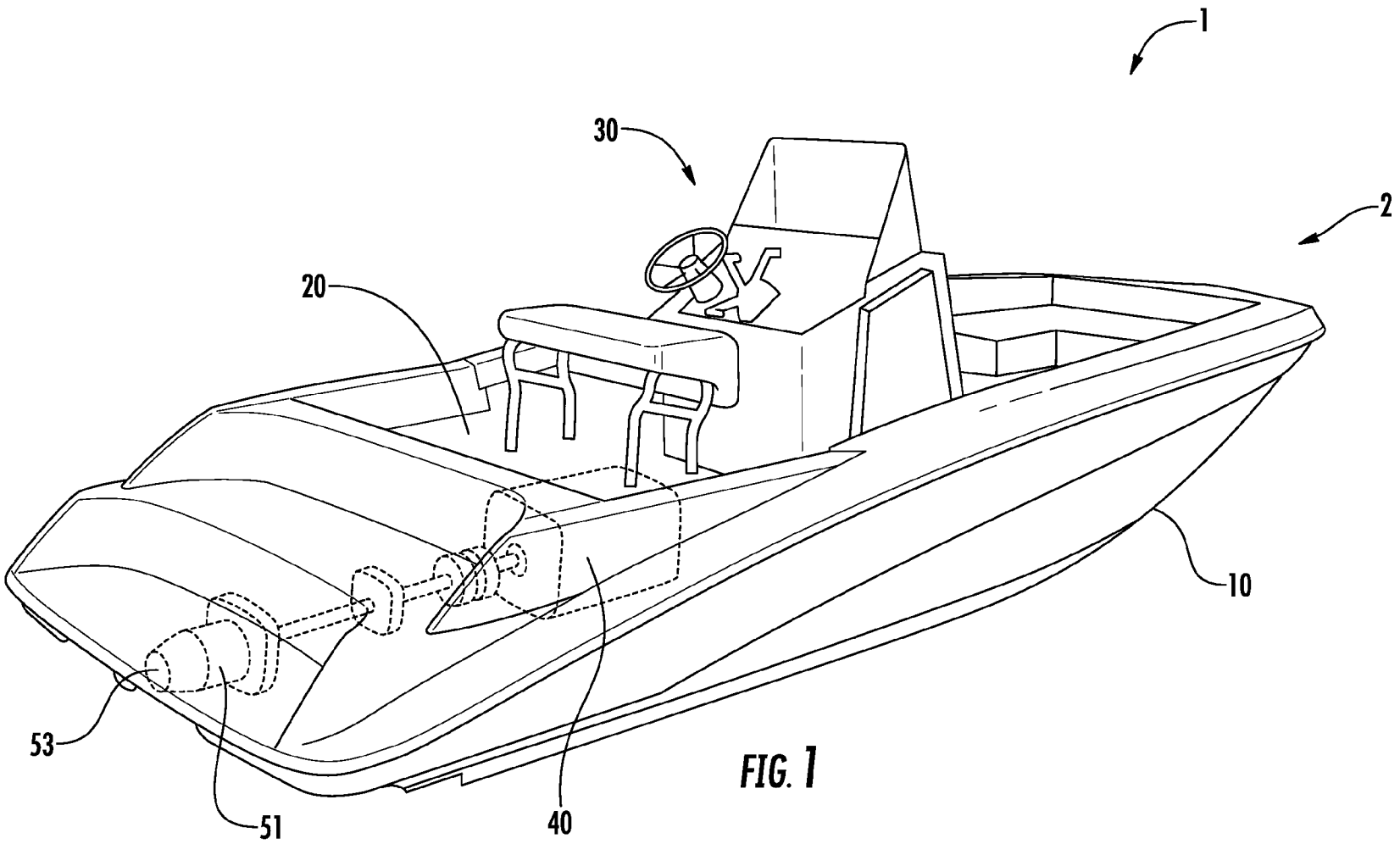
FIG. 1 is a perspective view of a boat according to a preferred embodiment of the present invention.

FIG. 1 shows a boat 1 according to a preferred embodiment of the present invention. The boat 1 includes a boat body 2, which in turn includes a hull 10 and a deck 20. A cockpit 30 is located on the deck 20. An engine 40 is disposed between the hull 10 and the deck 20. A jet propulsion unit 50 (see FIG. 6) is configured to be driven by the engine 40. The jet propulsion unit 50 includes a jet nozzle 51 configured to jet water rearward from a water outlet 53 located at a rear portion of the jet nozzle 51.

Figure 2:
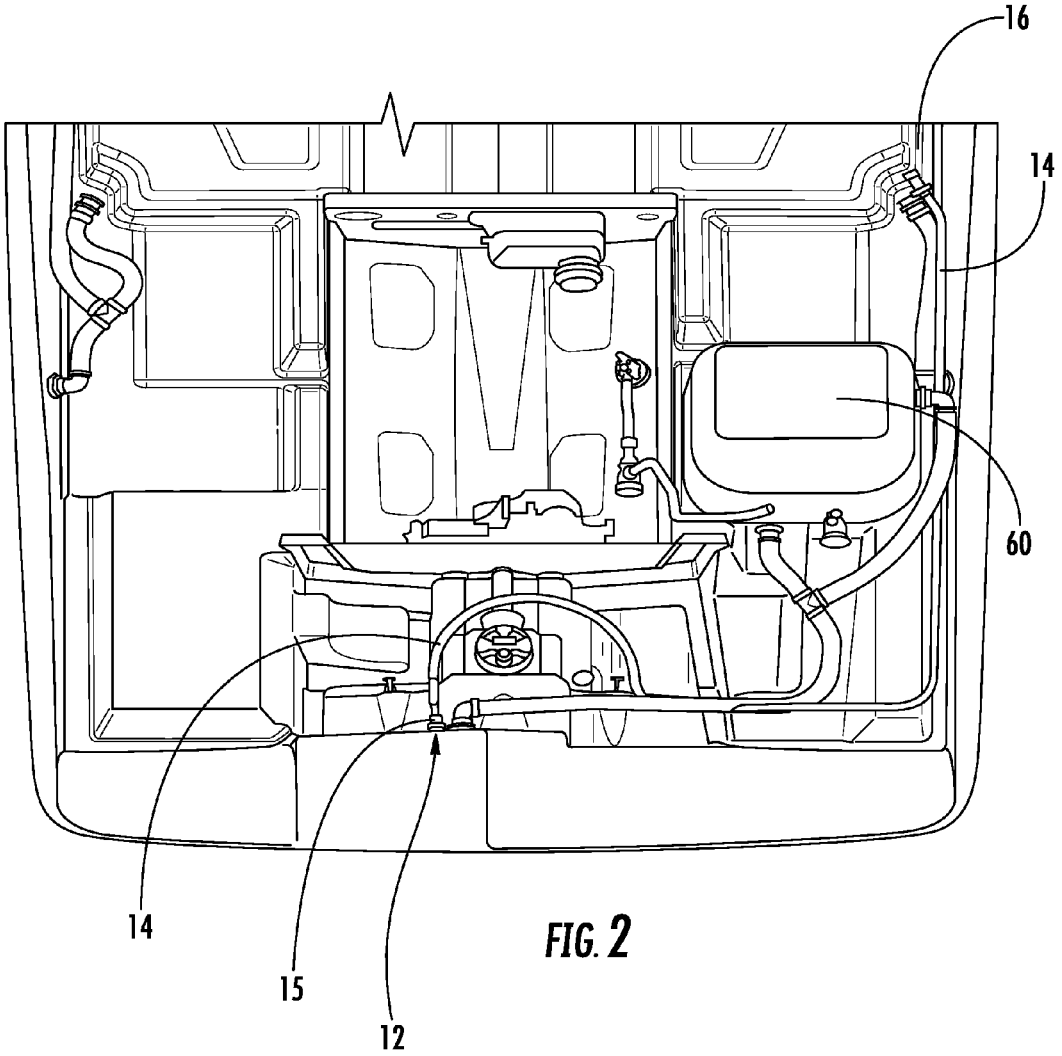
FIG. 2 is a plan view of a rear portion of the hull of the boat with the deck removed according to a preferred embodiment of the present invention.
Figure 3:
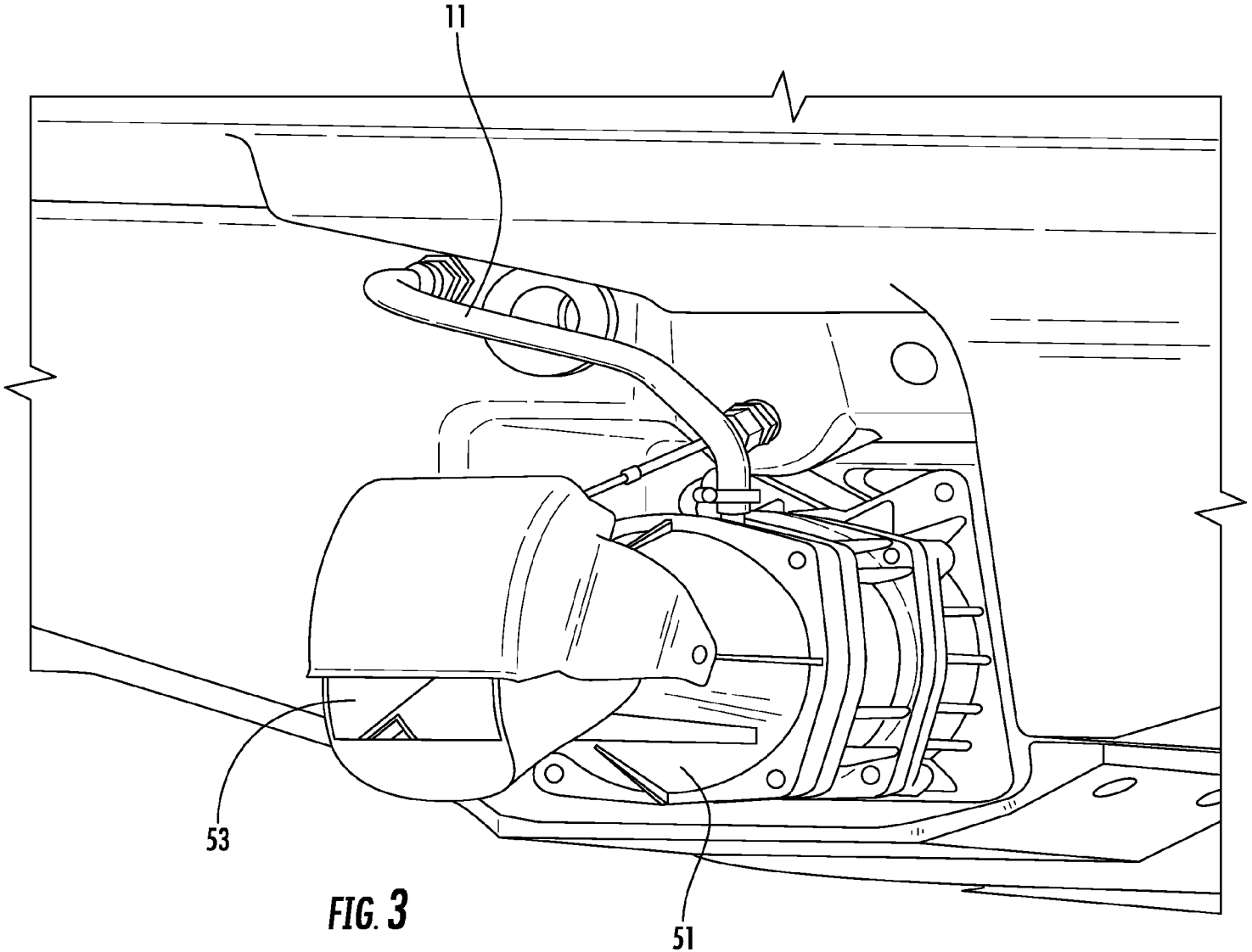
FIG. 3 is a rear perspective of a jet nozzle mounted to the rear of the hull according to a preferred embodiment of the present invention.
Figure 6:
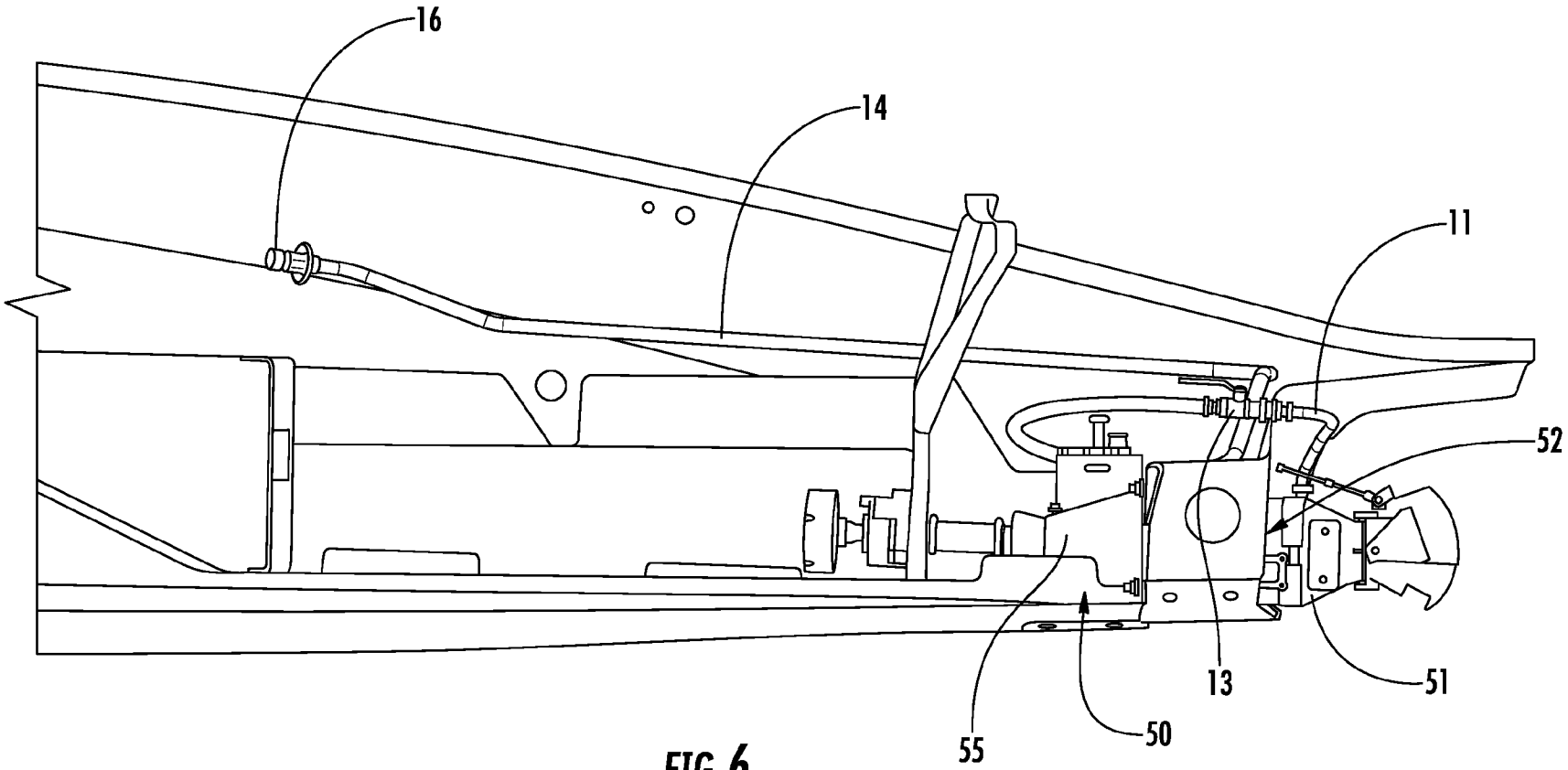
FIG. 6 is a cross-sectional side view of the boat showing a jet propulsion unit and a portion of the interior water passage according to a preferred embodiment of the present invention.

As shown in FIGS. 3 and 6, the jet nozzle 51 is disposed at the rear of the hull 10, and preferably on the outside of the hull 10. A water inlet 52 disposed at a front portion of the jet nozzle 51 is configured to receive water from an impeller 55 in the jet propulsion unit 50. The water pressurized by the impeller 55 is then jetted rearward from the water outlet 53 of the jet nozzle 51 to move the boat 1. A hole 54 (see FIG. 7) is provided between the water inlet 52 and the water outlet 53 of the jet nozzle 51. A water passage 11 is connected to the hole 54 in the jet nozzle 51 and to a water intake opening 12 (see FIG. 2) provided in the hull 10. The water passage 11 supplies pressurized water from the jet nozzle 51 to the water intake opening 12.

Figure 7:
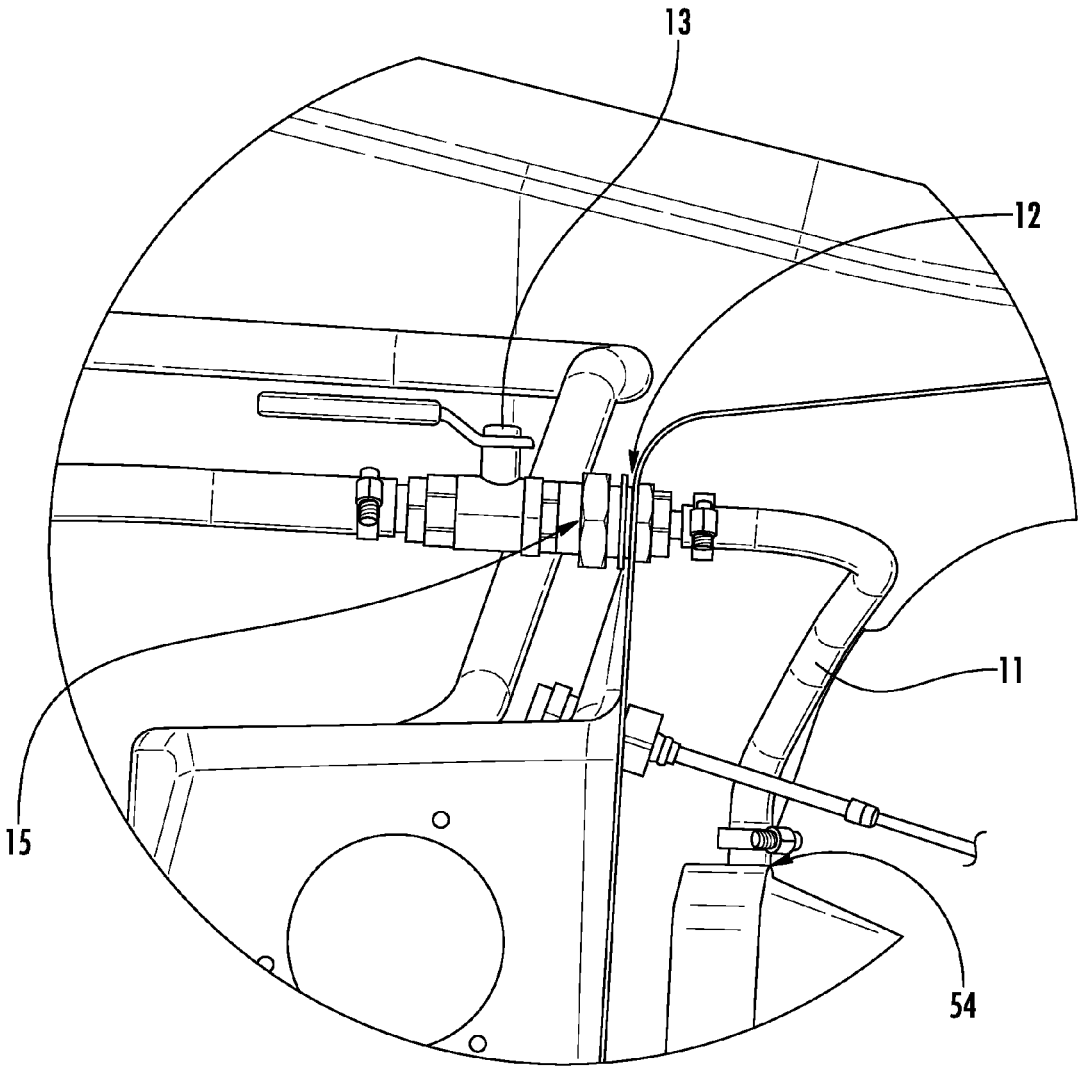
FIG. 7 is an enlarged cross-sectional view of the water passage and the interior water passage according to a preferred embodiment of the present invention.
Figure 8:
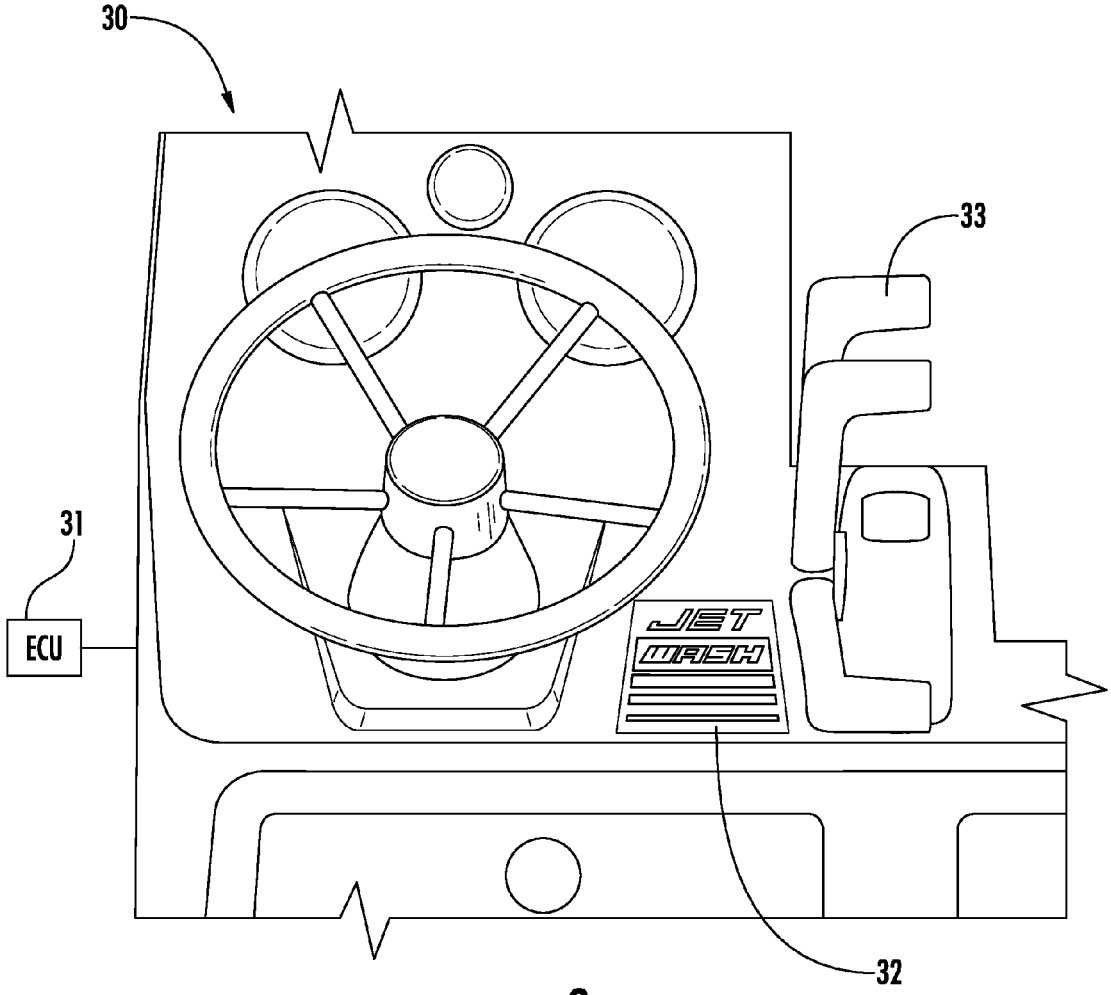
FIG. 8 is a view of the cockpit of the boat.

On the inside of the hull 10, a first end 15 of an interior water passage 14 is connected to the water intake opening 12. As shown in FIG. 7, a shut-off valve 13 is preferably provided at the first end 15 of the interior water passage 14 to prevent water from being supplied to the interior of the hull 10 when the shut-off valve 13 is closed. The shut-off valve 13 is preferably a manually operated valve. Alternatively, the shut-off valve 13 may be electrically controlled via an instruction from an ECU 31.

Figure 4:
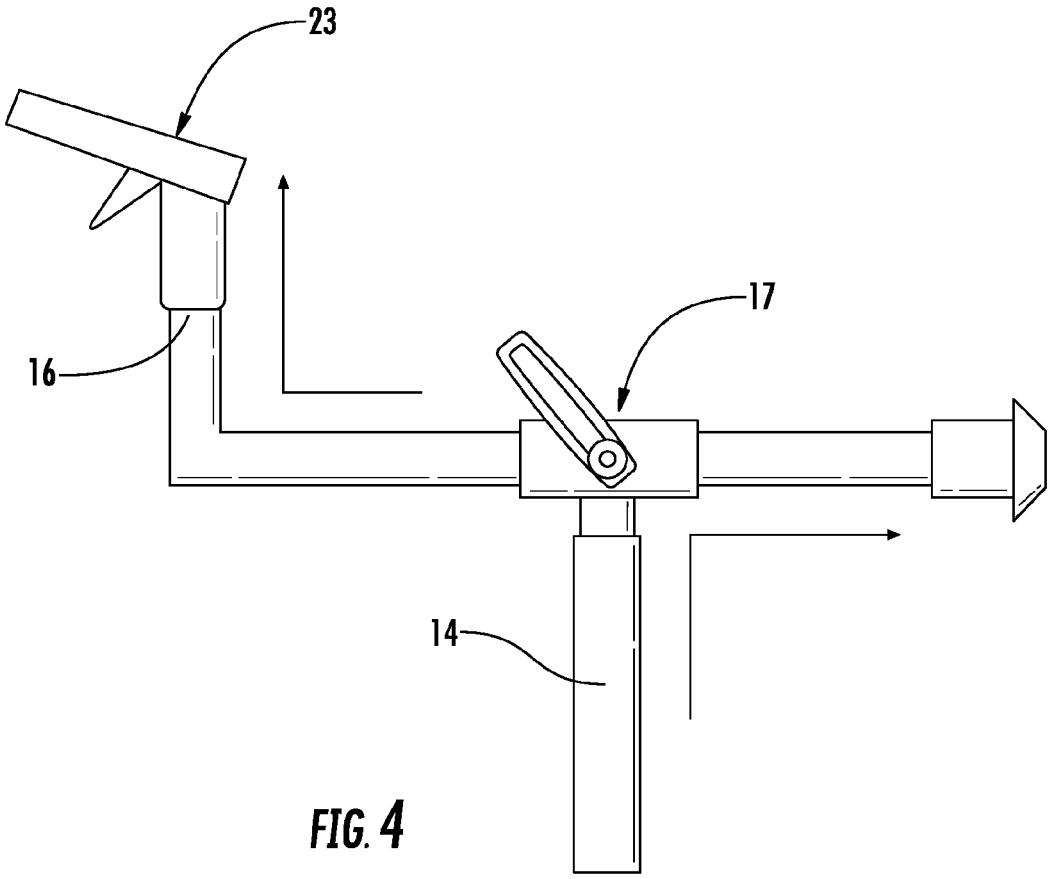
FIG. 4 is a schematic diagram of an interior water passage disposed in the interior of the hull according to a preferred embodiment of the present invention.

The interior water passage 14 extends into the interior of the hull 10, preferably between the hull 10 and the deck 20. As shown in FIG. 4, the interior water passage 14 preferably includes a multi-way valve 17 configured to divert the water to various devices on the boat 1. The multi-way valve 17 may be any known type of valve configured to divert water to one or more passages. Preferably, the multi-way valve 17 is manually operated. Alternatively, the multi-valve 17 may be electrically controlled via an instruction from the ECU 31.

Figure 5:
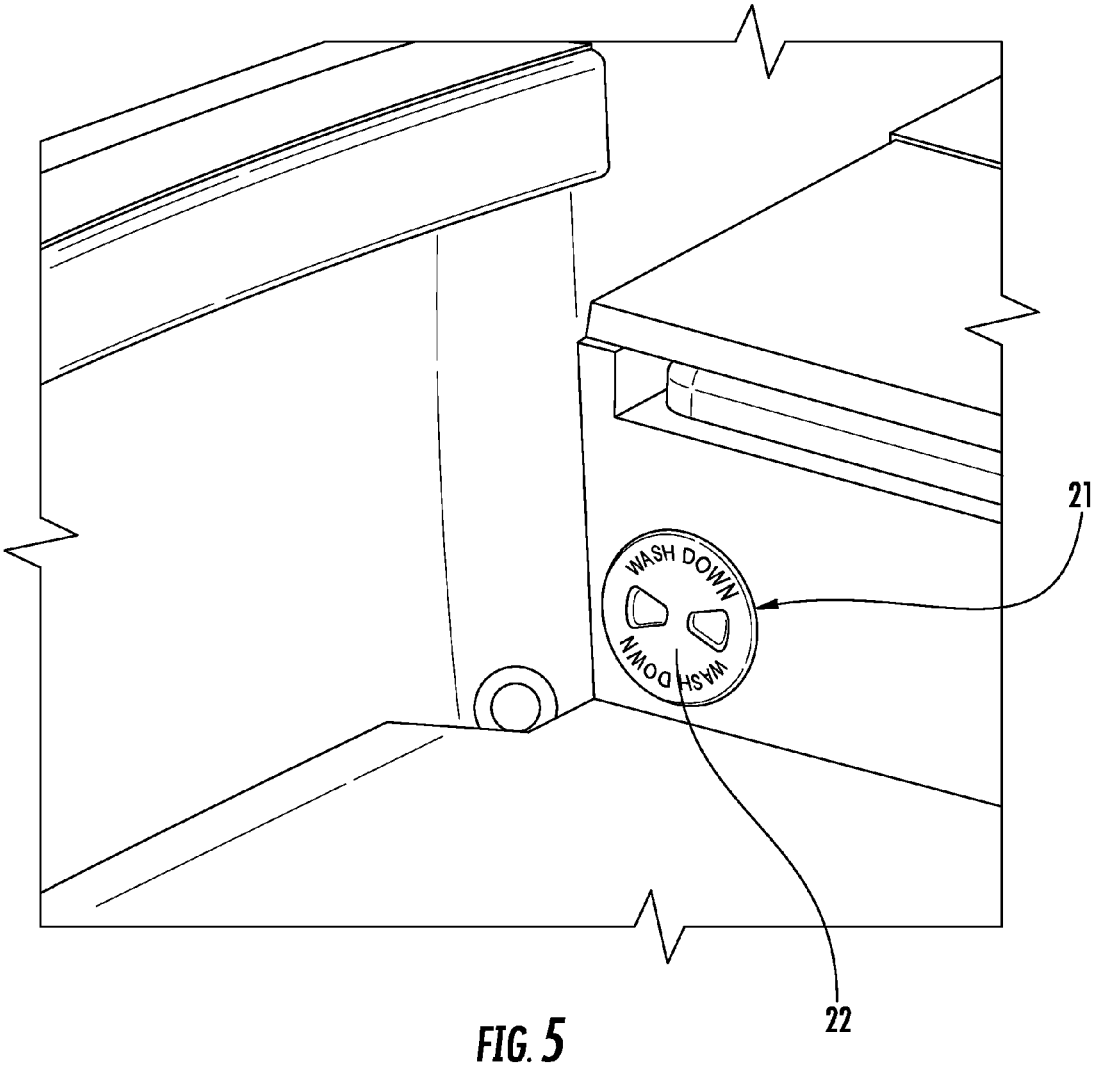
FIG. 5 is a perspective view showing a deck wash opening on the deck of the boat according to a preferred embodiment of the present invention.

According to a preferred embodiment of the present invention, the multi-way valve 17 is configured to divert the water to a portion of the interior water passage 14 that supplies pressurized water to the deck 20 of the boat 1. For example, as shown in FIGS. 2 and 6, a second end 16 of the interior water passage 14 terminates at a deck discharge opening 21 (see FIG. 5) provided in the deck 20. The deck discharge opening 21 shown in FIG. 5 preferably includes a fitting valve 22. The fitting valve 22 includes at least a first position configured to supply water from the interior water passage 14 to the deck discharge opening 21 and a second position configured to prevent water from being supplied from the interior water passage 14 to the deck discharge opening 21. The fitting valve 22 may be any known type of valve that opens and closes the deck discharge opening 21. FIG. 4 schematically shows a deck hose 23 that is configured to be connected to the deck discharge opening 21, and used to wash the deck 20 or the hull 10 of the boat 1.

According to a preferred embodiment of the present invention, the cockpit 20 preferably include a deck wash switch 32 configured to operate the deck wash system. More specifically, activating the deck wash switch 32 provides the desired pressure of water from the jet nozzle 51 to the deck hose 23. Activating the deck wash switch 32 causes the ECU 31 to set the rpm of the engine 40 to a predetermined rpm that rotates the impeller 55 to create a predetermined water pressure between the water inlet 52 and the water outlet 53 of the jet nozzle 51. Consequently, the desired pressure of water is supplied to the deck hose 23 so that the deck 20 and/or the hull 10 is efficiently washed.

According to a preferred embodiment of the present invention, the deck wash system preferably is only operable when the throttle lever 33 is generally in the neutral position (e.g., "Remocon Position" shown in FIG. 9). Alternatively, the deck wash system may be operated when the throttle lever 33 is in the forward or the neutral position. In such a case, the interior water passage 14 preferably includes a regulator in electrical communication with the ECU 31, which is configured or programmed to control the regulator in order to adjust the water pressure to the desired water pressure.

According to another preferred embodiment of the present invention, the interior water passage 14 is also connected to a baitwell 60 (also known as a livewell), as shown in FIG. 2. For example, the multi-way valve 17 is switched to supply water to the baitwell 60 instead of to the deck discharge opening 21. Similar to when the deck wash system is being operated, the ECU 31 is configured or programmed to set the rpm of the engine 40 to a predetermined rpm to create a predetermined water pressure between the water inlet 52 and the water outlet 53 of the jet nozzle 51 so that water is supplied to the baitwell 60 at the desired water pressure. Alternatively, the interior water passage 14 preferably includes a regulator in electrical communication with the ECU 31, which is configured or programmed to control the regulator in order to adjust the water pressure to the desired water pressure. For example, the regulator is preferably provided in a portion of the interior water passage 14 between the multi-way valve 17 and the baitwell 60.

Figure 10:
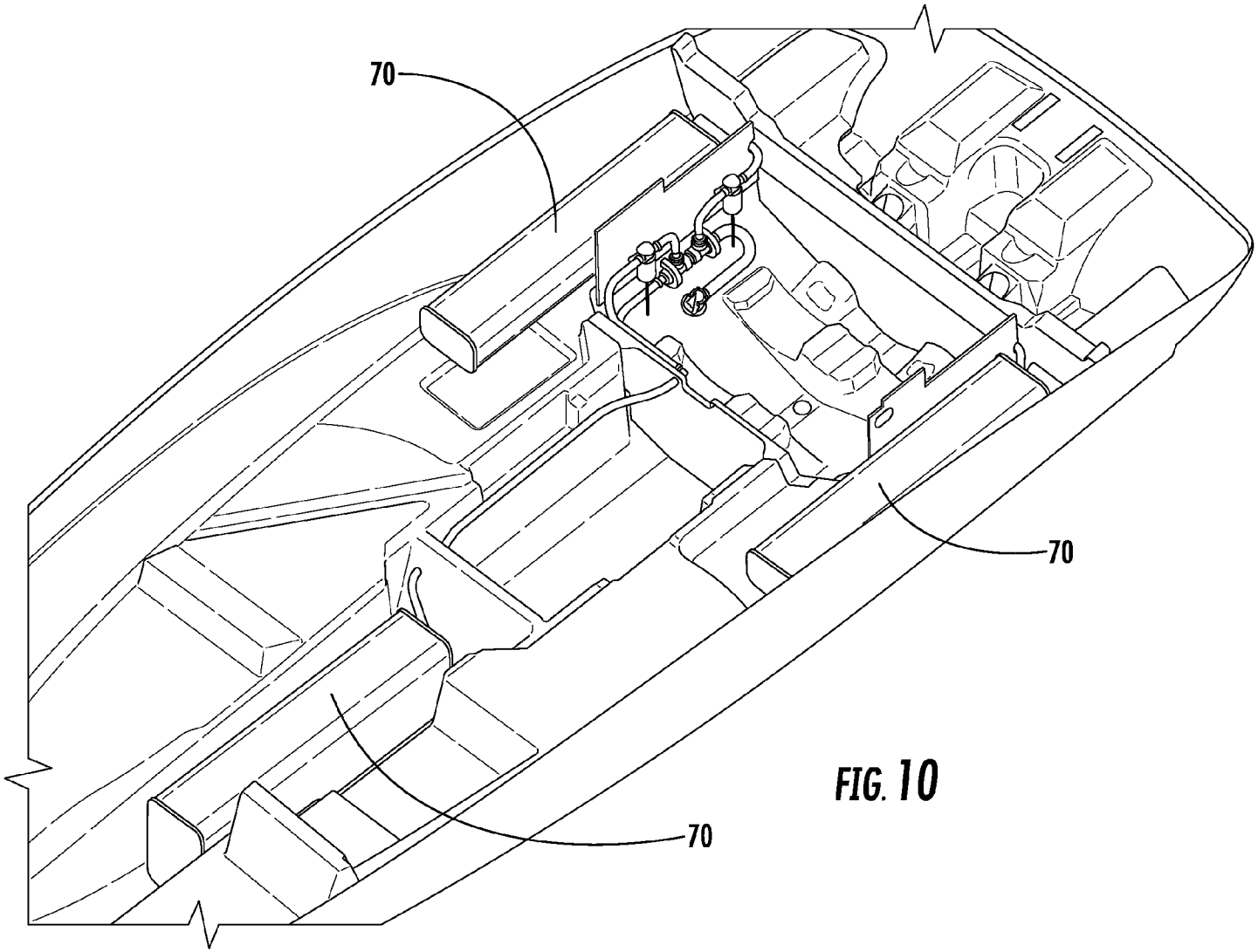
FIG. 10 is a perspective plan view of the hull of the boat with the deck removed according to another preferred embodiment of the present invention.

According to another preferred embodiment of the present invention, the interior water passage 14 is connected to one or more ballast tanks 70, as shown in FIG. 10. For example, the multi-way valve 17 may be switched to supply water to the one or more ballast tanks 70 instead of to the deck discharge opening 21. Although the multi-way valve 17 shown in FIG. 4 preferably is configured to divert water to two passages, the multi-way valve 17 may be configured to divert the water to only one passage or to three or more passages. Similar to when the deck wash system is being operated, the ECU 31 is configured or programmed to set the rpm of the engine 40 to a predetermined rpm to create a predetermined water pressure between the water inlet 52 and the water outlet 53 of the jet nozzle 51 so that water is supplied to the one or more ballast tanks 70 at the desired water pressure. Alternatively, the interior water passage 14 preferably includes a regulator in electrical communication with the ECU 31, which is configured or programmed to control the regulator in order to adjust the water pressure to the desired water pressure. For example, the regulator is preferably provided in a portion of the interior water passage 14 between the multi-way valve 17 and the one or more ballast tanks 70.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat comprising:

a body including a hull and a deck;

an engine disposed between the hull and the deck;

a jet propulsion unit configured to be driven by the engine, the jet propulsion unit including a jet nozzle configured to jet water therefrom;

a water passage configured to supply water from the jet nozzle to a water intake opening located in an interior of the hull;

an interior water passage disposed in the interior of the hull and between the hull and the deck; and a cockpit and an engine control unit; wherein the cockpit includes a deck wash switch, and when the deck wash switch is on, the engine control unit is configured or programmed to operate and keep the engine at a higher predetermined rpm than a predetermined rpm when a throttle lever is in a neutral position;

the interior water passage includes a first end connected to the water intake opening and a second end configured to discharge water to the interior of the hull;

the water passage is connected to the jet nozzle outside of the hull; and the jet nozzle is spaced from any valve that controls a flow of water to the water passage.

2. The boat according to claim 1, wherein the water intake opening includes a shut-off valve located in the interior of the hull, and the shut-off valve is configured to stop water from being supplied to the interior of the hull.

3. The boat according to claim 1, wherein the second end of the interior water passage is connected to a deck discharge opening on the deck, the deck discharge opening includes a fitting valve, and the fitting valve is configured to move to at least a first position to supply water from the interior water passage to the deck discharge opening and a second position to prevent water from being supplied from the interior water passage to the deck discharge opening.

4. The boat according to claim 3, further comprising a deck hose connected to the deck discharge opening.

5. The boat according to claim 1, wherein the interior water passage includes a multi-way valve configured to divert water to one or more passages.

6. The boat according to claim 5, wherein a portion of the interior water passage extends from the multi-way valve to the deck.

7. The boat according to claim 1, wherein the jet nozzle is disposed outside of the hull.

8. The boat according to claim 1, wherein the second end of the interior water passage is connected to a baitwell.

9. The boat according to claim 1, wherein the second end of the interior water passage is connected to a ballast tank.

10. The boat according to claim 1, wherein the engine control unit is configured or programmed to operate the engine at the higher predetermined rpm in order to supply a desired pressure of water to a deck hose to wash the hull.

11. The boat according to claim 1, wherein the jet nozzle does not include a valve that controls a flow of water to the water passage.

* * * * *